US009147391B2

(12) United States Patent
Bieler

(10) Patent No.: US 9,147,391 B2
(45) Date of Patent: Sep. 29, 2015

(54) AIRCRAFT PREDICTIVE ACTIVE NOISE CANCELLATION

(71) Applicant: Virgin America Inc., Burlingame, CA (US)

(72) Inventor: Kenneth Hal Bieler, Walnut Creek, CA (US)

(73) Assignee: Virgin America Inc., Burlingame, CA (US)

( * ) Notice: Subject to any disclaimer, the term of this patent is extended or adjusted under 35 U.S.C. 154(b) by 0 days.

(21) Appl. No.: 14/212,003

(22) Filed: Mar. 14, 2014

(65) Prior Publication Data

US 2014/0270220 A1 Sep. 18, 2014

Related U.S. Application Data

(60) Provisional application No. 61/792,894, filed on Mar. 15, 2013.

(51) Int. Cl.
*G10K 11/16* (2006.01)
*G10K 11/178* (2006.01)

(52) U.S. Cl.
CPC .... *G10K 11/1788* (2013.01); *G10K 2210/1081* (2013.01); *G10K 2210/1281* (2013.01); *G10K 2210/3055* (2013.01)

(58) Field of Classification Search
CPC ..... G10K 2210/108; G10K 2210/1081; G10K 2210/121; G10K 2210/12; G10K 2210/1281; G10K 11/16; G10K 11/1788
USPC ..... 381/71.8, 71.6, 71.1
See application file for complete search history.

(56) References Cited

U.S. PATENT DOCUMENTS 7,567,677 B1 * 7/2009 Chan et al. ..... 381/71.1
2003/0016833 A1 1/2003 Harvey
2005/0238179 A1 10/2005 Erdmann (Continued)

FOREIGN PATENT DOCUMENTS

CA 2346756 3/2008
KR 10-2010-0064345 A 6/2010

(Continued)

OTHER PUBLICATIONS

Australian First Examination Report, Australian Application No. 2014201951, May 29, 2014, 5 pages.

(Continued)

*Primary Examiner* — Ping Lee
(74) *Attorney, Agent, or Firm* — Fenwick & West LLP

(57) ABSTRACT

An improved user experience is provided for passengers of a transportation vessel, such as an airplane. A passenger's experience is enhanced by allowing the passenger to enjoy media provided by an entertainment device without ambient noise. When the passenger requests accesses to a media item through the entertainment device, a microphone in the entertainment system generates an ambient noise signal based on captured ambient noise. A noise cancellation device generates a predictive noise cancelling signal based on the ambient noise signal. To generate the predictive noise cancelling signal, the noise cancellation device inverts the ambient noise signal and applies a predictive phase shift to the signal based on an estimated distance between the microphone and the passenger's ears. The noise cancelling signal is mixed with audio of the media item.

11 Claims, 9 Drawing Sheets

(56) References Cited

U.S. PATENT DOCUMENTS

| | | | | |
|---|---|---|---|---|
| 2005/0254664 | A1* | 11/2005 | Kwong et al. | 381/71.8 |
| 2007/0223714 | A1 | 9/2007 | Nishikawa | |
| 2008/0247560 | A1 | 10/2008 | Fukuda et al. | |
| 2009/0034755 | A1 | 2/2009 | Short et al. | |
| 2009/0274320 | A1 | 11/2009 | Kino et al. | |
| 2010/0061563 | A1 | 3/2010 | Gelhard et al. | |
| 2012/0250879 | A1 | 10/2012 | Moody | |
| 2012/0288110 | A1 | 11/2012 | Cherkassky et al. | |

FOREIGN PATENT DOCUMENTS

| | | | |
|---|---|---|---|
| WO | WO 97/25790 | A2 | 7/1997 |
| WO | WO 99/05998 | A1 | 2/1999 |

OTHER PUBLICATIONS

PCT International Search Report and Written Opinion, PCT Application No. PCT/US2014/028066, Jul. 7, 2014, 7 pages.

* cited by examiner

AIRCRAFT PREDICTIVE ACTIVE NOISE CANCELLATION

CROSS-REFERENCE TO RELATED APPLICATION

This application claims the benefit of provisional application 61/792,894, filed on Mar. 15, 2013, which is incorporated by reference herein in its entirety.

BACKGROUND

1. Field

The embodiments disclosed herein relate generally to active noise cancellation. More specifically, the embodiments disclosed herein are directed towards the cancellation of ambient noise in transportation vessels.

2. Description of the Related Art

Commercial transportation vessels designed to carry passengers often include entertainment systems. For example, many airlines operate airplanes that include displays mounted on the back of each seat, allowing passengers to watch movies. However, the noises generated by the airplane (e.g., airplane jet engines and aerodynamic noises) and the passengers make it difficult to enjoy the entertainment even when wearing headphones.

SUMMARY

Described embodiments enable an improved user experience for passengers of a transportation vessel, such as an airplane. In one embodiment, when a passenger of an airplane requests accesses to a media item through an entertainment device, a preditictive active noise cancellation feature is employed. As part of the active noise cancellation feature, a microphone generates an ambient noise signal based on captured ambient noise. A noise cancellation device generates a noise cancelling signal based on the wave form and frequency distribution of the ambient noise signal. To generate the noise cancelling signal, the noise cancellation device inverts the ambient noise signal and applies a predictive phase shift based on an estimated distance between the microphone and a location of the passenger. The noise cancelling signal is mixed with audio of the media item. If the passenger requests an adjustment to the phase shift being applied for the noise cancelling signal, an adjustment is made to the applied phase shift according to the request.

In one embodiment, the predictive phase shift initially applied to the ambient noise signal is based on an average distance between the microphone and a passenger's ear. However, since passengers are of different heights and the distance between the microphone and the ears of passengers will vary, a passenger can fine tune the noise canceling signal by requesting a phase shift adjustment for the noise canceling signal.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

DETAILED DESCRIPTION OF THE PREFERRED EMBODIMENTS

Figure 1:
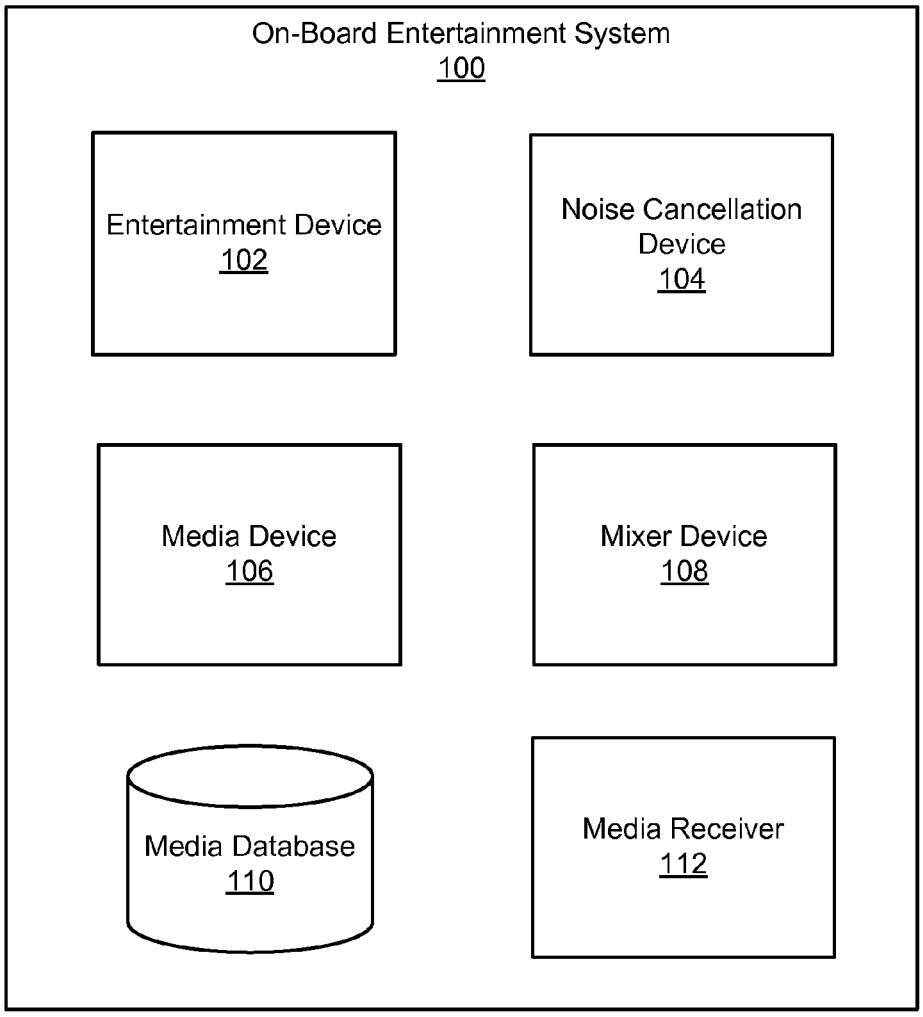
FIG. 1 illustrates a block diagram of an on-board entertainment system according to one embodiment.

FIG. 1 illustrates a block diagram of an on-board entertainment system 100 according to one embodiment. In one embodiment, the on-board entertainment system 100 is included within a transportation vessel, such as an airplane, an automobile, or a train. The on-board entertainment system 100 allows passengers of the transportation vessel to enjoy different types of media (e.g., videos, movies, music, and video games) while limiting the amount of ambient noise heard by the passengers. The on-board entertainment system 100 includes an entertainment device 102, a noise cancellation device 104, a media device 106, a mixer device 108, a media database 110, and a media receiver 112.

The entertainment device 102 is a device through which a user can interact with the on-board entertainment system 100. Although FIG. 1 illustrates a single entertainment device 102, the on-board entertainment system 100 may include multiple entertainment devices, for example one per passenger.

Figure 4:
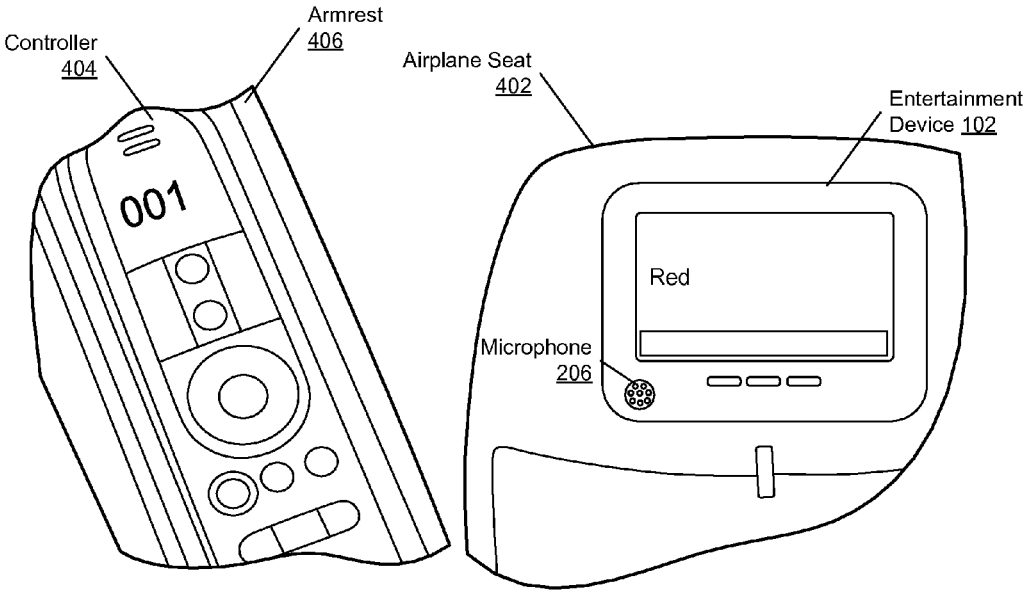
FIG. 4 illustrates an entertainment device and a controller of the entertainment device according to one embodiment.

In one embodiment, the entertainment device 102 is mounted on the back of a seat. FIG. 4 illustrates the entertainment device 102 mounted on the back of an airplane seat 402 in front of a passenger and a controller 404 of the device 102 stored in the armrest 406 of a seat of the passenger. In another embodiment, electronic device 102 is stored in the armrest of a seat. In an alternative embodiment, entertainment device 102 is a portable device and may, for example, be distributed to passengers while en route to their destination.

Through the entertainment device 102 a user can request and access media items stored by the media database 110 or received by the media receiver 112. A media item includes one or more of the following types of media: text, audio, video, still images, moving images, animation, etc. The media database 110 stores files of multiple media items. For example, the media database 110 may store movies, songs, and video games. The media receiver 112 receives media items via an antenna. For example, the media receiver 112 may receive television and/or radio transmissions. In one embodiment, the media receiver 112 is a satellite receiver that receives transmissions from a satellite broadcaster.

Figure 2:
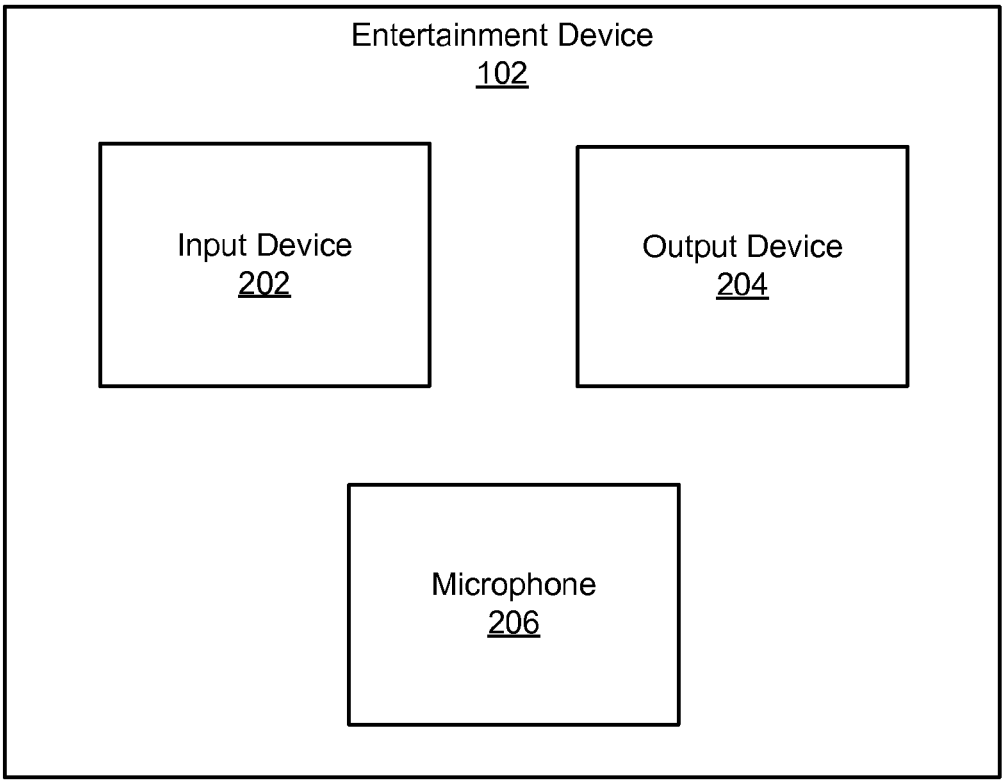
FIG. 2 illustrates components of an entertainment device according to one embodiment.

As shown in FIG. 2, the entertainment device 102 includes an input device 202, output device 204, and microphone 206 according to one embodiment. The input device 202 is a device through which a user can provide instructions to the entertainment device 102. In one embodiment, through the input device 202 a user can request access to media items available through the on-board entertainment system 100. In one embodiment, the input device 202 is a controller with multiple control keys/buttons, such as the controller 404 shown in FIG. 4. In one embodiment, the input device 202 is a touch screen in which a touch-sensitive, transparent panel covers the screen of the output device 204. The entertainment device 102 may include multiple input devices 202. In one embodiment, the entertainment device 102 includes a controller and a touch screen as input devices 202.

Figure 3:
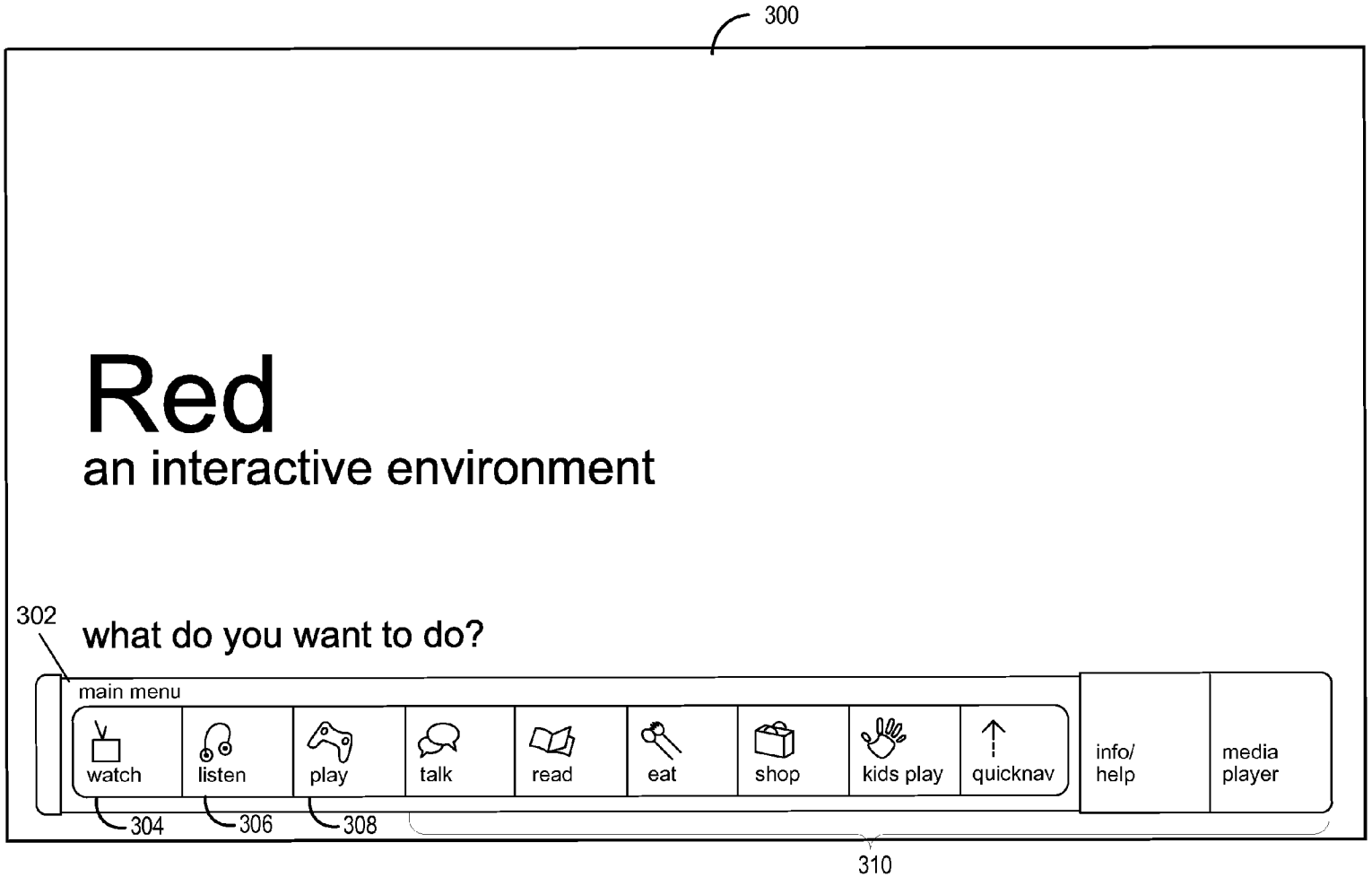
FIG. 3 illustrates a user interface including a navigation menu according to one embodiment.

The output device 204 presents electronic images and data to a user. In one embodiment, the display is an organic light emitting diode display (OLED) or liquid crystal display (LCD). In one embodiment, the output device 204 presents visual content of media items accessed by users. In one embodiment, the output device 204 presents a user interface to a user that allows the user to access media items. FIG. 3 illustrates an example of an interface 300 presented to a user with a navigation menu 302. In this example, the menu 302 includes interface element 304 which provides access to a catalogs of media items that can be watched, such as movies, music videos, and television programming. Interface element 306 of the menu 306 provides access to a catalog of audio files, such as files of songs and books on audio. Interface element 308 of the menu 302 provides access to a catalog of video games. Other interface elements 310 of the navigation menu 302 provide access to other entertainment and service options provided by the on-board entertainment system 100.

Returning to FIG. 2, the microphone 206 is a transducer that captures ambient sound surrounding the microphone 206 and converts the sound into an electrical signal (ambient noise signal) representative of the captured ambient sound. The ambient noise signal generated by the microphone 206 is used by the noise cancellation device 104 for noise cancelling purposes as described below.

In this embodiment, the microphone 206 is incorporated into entertainment device 102, as shown in FIG. 4. In other embodiments, the microphone 206 is positioned at a distance from the entertainment device 102. For example, the microphone 206 could be installed on the airplane seat away from the entertainment device 102 or on an armrest of a seat.

Referring to FIG. 1, the noise cancellation device 104 is a device that generates a noise cancelling signal based on ambient sounds captured by the microphone 206. The noise cancelling signal allows a user to enjoy media items available through the on-board entertainment system 100 while limiting the amount of ambient noise heard by the user. The process of generating a noise cancelling signal to reduce the amount of ambient noise heard by a user is referred to as the active noise cancellation feature. The active noise cancellation feature can be enabled or disabled by a user through the entertainment device 102. In one embodiment, the active noise cancellation feature is automatically enabled when a user accesses a media item through the on-board entertainment system 100. For example, the noise cancellation feature may be enabled when a user plays a movie or a song.

When the active noise cancellation feature is enabled, the microphone 206 captures the ambient noise and generates a continuous ambient noise signal representative of the ambient noise surrounding the microphone 206. The noise cancellation device 104 receives the ambient noise signal and inverts the signal to generate a continuous noise cancelling signal (produces a signal equal in amplitude but opposite in polarity to the ambient noise signal). Since the phases of the ambient noise signal and the noise cancelling signal are opposite to each other, the noise cancelling signal eliminates most if not all the ambient noise.

Figure 5A:
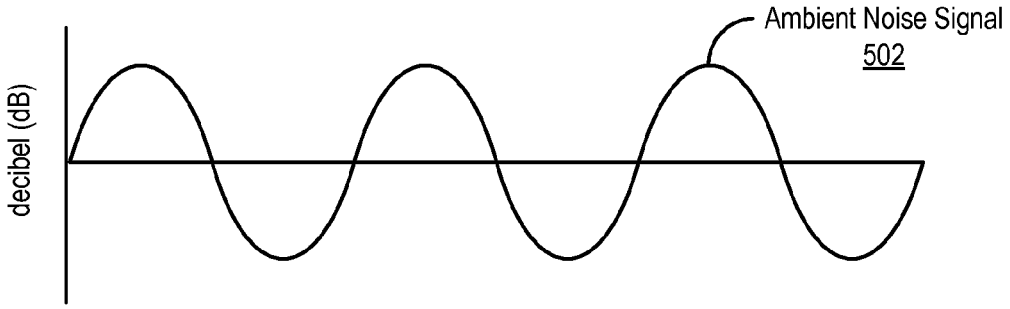
FIGS. 5A, 5B, and 5C illustrate noise cancellation according to the location of a microphone in accordance with one embodiment.
Figure 5B:
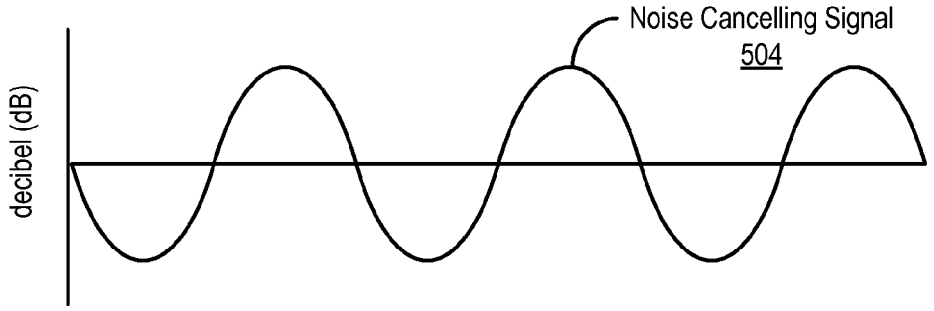
Figure 5C:
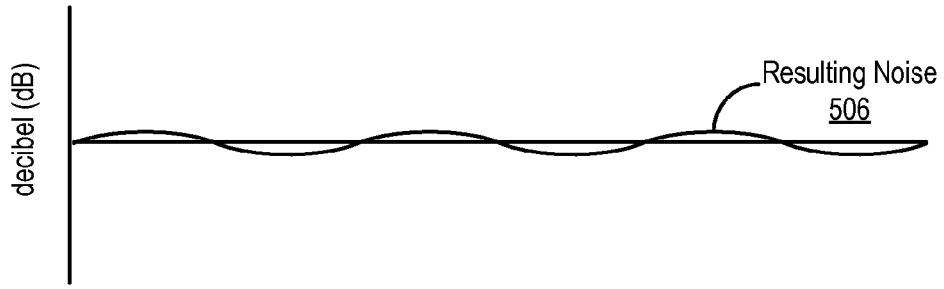

The effects of the noise cancelling signal are shown in FIGS. 5A-5C. FIG. 5A illustrates the ambient noise signal 502 generated by the microphone 206. FIG. 5B illustrates the noise cancelling signal 504 generated by the noise cancellation device 104 based on the ambient noise signal 502. FIG. 5C illustrates that when the ambient noise signal 502 combines with the noise cancelling signal 504, most of the ambient noise 506 is eliminated.

However, the location at which the passenger perceives ambient noise is not identical to the location of the microphone 206. For example, in an aircraft having a seat-back entertainment system and microphone 206, as shown in FIG. 4, there may be a distance of about 30-60 centimeters between the passenger's ears and the microphone 206. This distance results in a phase difference between the ambient noise captured by the microphone 206 and the ambient noise perceived by the user. The phase difference, for example, may be $1.66\times10^{-3}$ seconds or $1.8\times10^{-3}$ seconds.

Figure 6A:
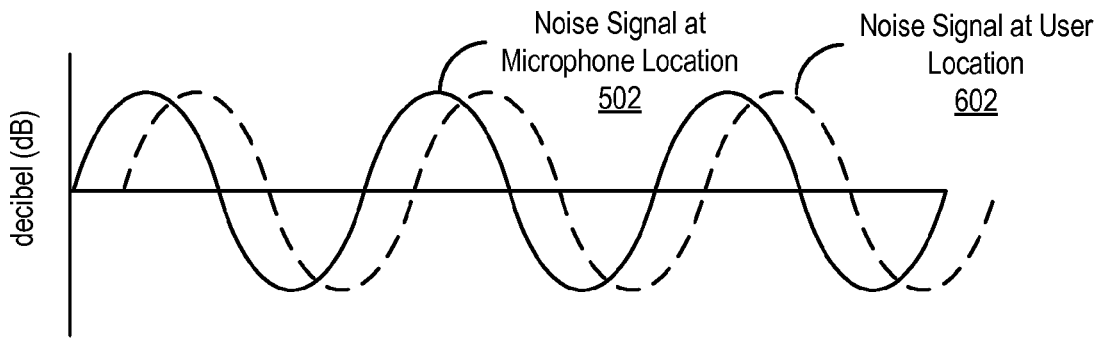
FIGS. 6A and 6B illustrate accounting for a distance between a microphone and a location of a user in noise cancellation according to one embodiment.
Figure 6B:
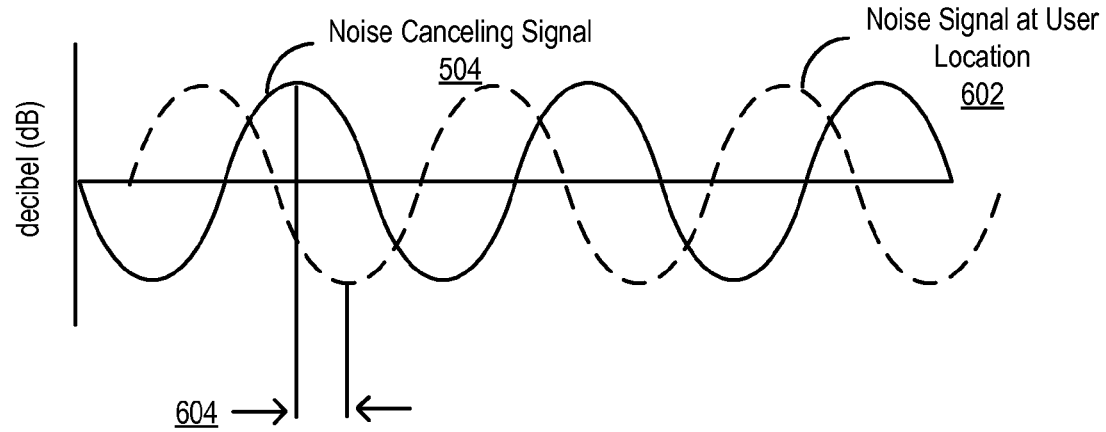

FIG. 6A illustrates an example of the ambient noise signal 502 generated by the microphone 206 being out of phase with respect to the user of the entertainment device 102. FIG. 6A includes the ambient noise signal 502 generated by the microphone 206 and a noise signal 602 at the location where the user hears the ambient noise. The noise signal 602 at the location where the user hears the noise has a different phase than the noise signal 502 generated by the microphone 206. Since ambient noise signal 502 is out of phase with respect to noise signal 602, the noise cancelling signal 504 generated by the noise cancellation device 104 is also out of phase with respect to noise signal 602 as illustrated by element 604 of FIG. 6B.

Because of the phase difference, inverting the ambient noise signal received from the microphone 206 is not sufficient for effectively eliminating the ambient noise heard by the user. Therefore, in addition to inverting the ambient noise signal generated by the microphone 206, the noise cancellation device 104 applies a phase shift to the signal to account for the distance between the microphone 206 and where the user hears the ambient noise. The phase shift applied by the noise cancellation device 104 to the signal is based on a distance between the microphone 206 and a location of the user (e.g., user's ears). Specially, the phase shift applied is a time required for the ambient noise to travel the distance from the microphone to the user.

In one embodiment, the noise cancellation device 104 calculates the phase shift to apply by dividing a distance between the microphone 206 and the location of the user by the current speed of sound in the cabin of the transportation vessel, as shown in the equation below:

$$\text{Phase Shift}=\text{Distance}\div\text{Speed of Sound in Cabin}$$

In some embodiments, the distance between the microphone 206 and the location of the user is known (e.g., if both the position of the microphone 206 and the position of the user are relatively fixed) and provided to the noise cancellation device 104 (e.g., by a system administrator). In alternative embodiments, the distance used in calculating the phase shift is an estimated distance between the microphone 206 and the location of the user. In these embodiments, since the phase shift is based on an estimated distance, the phase shift is a prediction of the adjustment that is necessary for the user not to hear the ambient noise.

In one embodiment, the estimated distance used in calculating the phase shift is based on default parameters, for example, the average distance of a user from the microphone 206. In one embodiment, based on an average distance of a user from the microphone 206, the phase shift applied by the noise cancellation device 104 is approximately $1.8\times10^{-3}$ seconds. In one embodiment, the estimated distance used by the noise cancellation device 104 varies based on the position of the user's seat and/or based on the position of the seat in front of the user (e.g., the seat that includes the entertainment device 102). For example, if both seats are in an upright position, a first estimated distanced is used. If both seats are in a reclined position, a second estimated distance is used. If only one of the seats is in a reclined position, a third estimated distance is used.

In one embodiment, the noise cancellation device 104 has access to information on the height of the particular user and the noise cancellation device 104 estimates the distance between the microphone 206 and a location of the user (e.g., user's ears) based on the user's height. In one embodiment, the height information is manually input by the user (e.g., through a query provided by the entertainment device 102). In another embodiment, the height information is obtained by the noise cancellation device 104 from one or more of the following: a loyalty program profile of the user, a social network profile, and a user profile created with the entertainment device 102.

The speed of sound in the cabin used in calculating the phase shift is determined by the noise cancellation device 104 based on the current temperature in the cabin. In one embodiment, the noise cancellation device 104 calculates the speed of sound in the cabin using the following equation:

$$\text{Speed of Sound in Cabin} = 331.3\ \text{m/s} \times \sqrt{1 + \frac{T}{273.15^\circ\ \text{C.}}}$$

T is the cabin temperature in degrees Celsius. In one embodiment, the entertainment system 100 includes a thermometer in the cabin that generates the temperature used by the noise cancellation device 104. In one embodiment, the thermometer is part of the entertainment device 102 (e.g., thermometer is next to the microphone 206).

After applying the phase shift, the noise cancellation device 104 outputs the generated noise cancelling signal to the mixer device 108. Based on the signal, sound is generated that prevents the user from hearing the ambient noise, as further described below.

In one embodiment, the user can adjust the phase shift being applied to the noise cancelling signal using the entertainment device 102. For example, when the applied phase shift is based on an estimated distance between the microphone 206 and a location of the user, the noise cancelling signal may need minor adjustments to maximize that amount of ambient noise eliminated. Based on what the user hears, the user can request adjustments to the phase shift used for the noise cancelling signal. When the user requests an adjustment to the phase shift, the noise cancellation device 104 adjusts the phase shift being applied to generate the noise cancelling signal according to the request and continues to output the signal to the mixer device 108.

Figure 7:
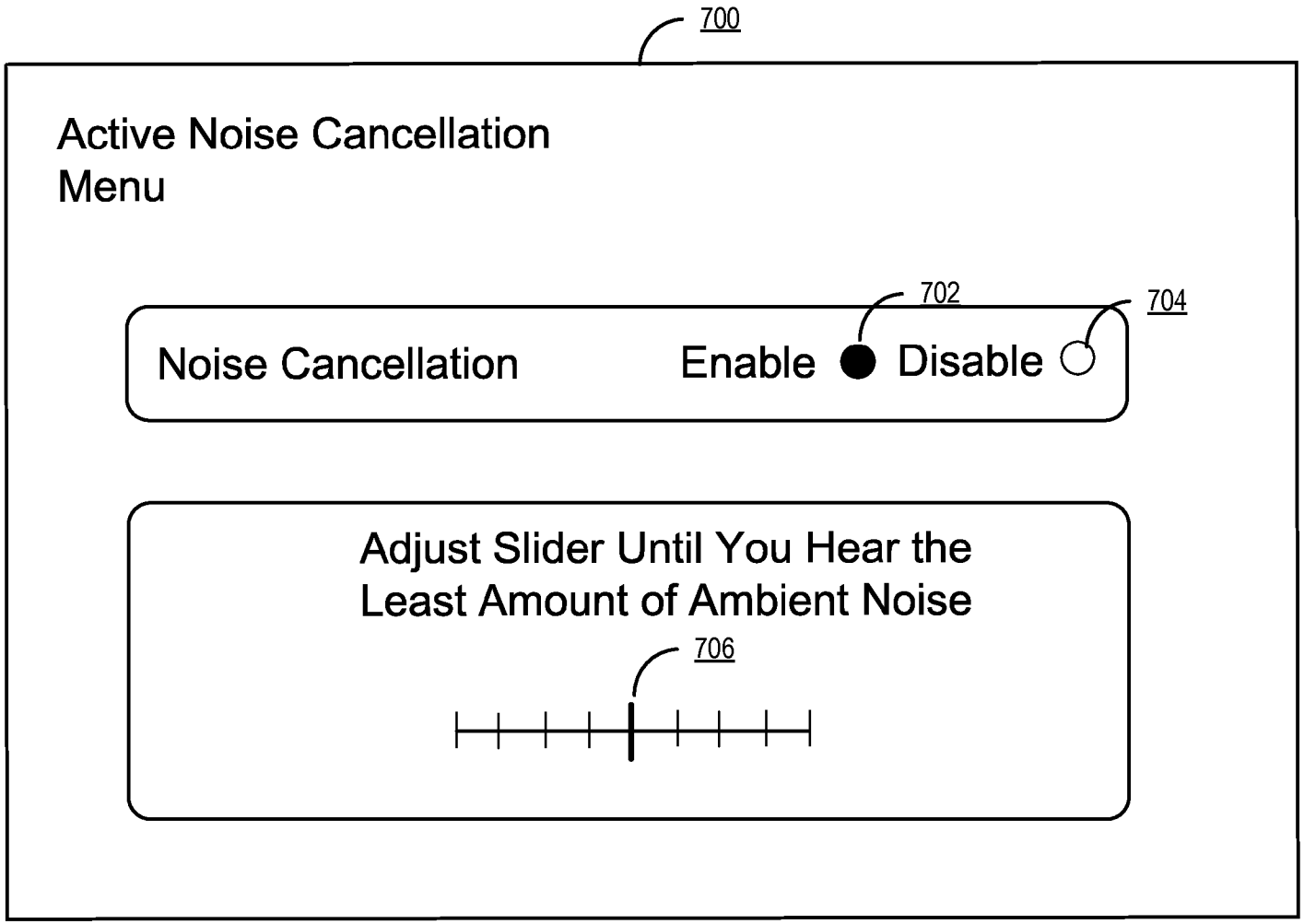
FIG. 7 illustrates a user interface including an active noise cancellation menu according to one embodiment.

FIG. 7 illustrates an example of an interface 700 presented to the user through the entertainment device 102 to allow the user to control the active noise cancellation feature. With button 702 the user can enable the active noise cancellation feature and with button 704 the user can disable the feature. Slider 706 allows the user to request adjustments to the phase shift being applied to the noise cancelling signal by moving slider 706. Using the slider 706 allows the user to maximize the amount of ambient noise eliminated by the noise cancelling signal.

In another embodiment, the noise cancellation device 104 generates multiple samples that include the noise cancelling signal with a different phase shift applied for each sample. The user can select which sample sounds the best (e.g., which sample includes the least amount of ambient noise). Based on the sample selected, additional samples are generated, where a different phase shift is applied for each additional sample. The phase shift for each additional sample is near (e.g., within a certain range of) the phase shift of the sample selected by the user. From the additional samples, the user can select which additional sample sounds the best. The process of generating additional samples based on a sample selected by the user may be repeated multiple times. Generating additional samples allows for fine tuning the selection of the phase shift to apply.

Once the user selects a final sample that sounds the best from all the samples generated, the noise cancellation device 108 uses the phase of the final sample to generate the noise cancelling signal that is output to the mixer device 108. This method is similar to an optometrist performing an eye test to find the right optical prescription for a patient. In this manner the system 100 can determine the best predictive offset to apply for the direction and nature of the ambient noise source (e.g., airflow noise coming from the front and/or engine noise coming from behind). In addition as engine noise has a different frequency range from airflow noise, it is possible to apply multiple offsets to address different noise sources.

The noise cancellation device 104 has been described as inverting the ambient noise signal and then applying the phase shift to account for the distance between the user and microphone 206. However, in other embodiments, the phase shift may be applied to the ambient noise signal prior to inverting the signal. For example, the phase shift may be applied to the ambient noise signal generated by the microphone 206 and after applying the phase shift the signal is inverted.

The media device 106 provides users with access to media items stored in the media database 110 and received by the media receiver 112. When a user requests access to a media item, the media device 106 obtains the media item either from the media database 110 or the media receiver 112. If the media item has visual content associated with it, the media device 106 outputs the visual content of the media item to the entertainment device 102 so that the visual content is displayed to the user. Additionally, if the media item has audio content associated with it, the media device 106 outputs a media item audio signal to the mixer device 108. The media item's audio signal represents the audio of the media item.

The mixer device 108 generates an audio mix signal based on outputs from the noise cancellation device 104 and the media device 106. In one embodiment, the mixer device 108 combines the noise cancelling signal received from the noise cancellation device 104 and the media item audio signal received from the media device 106. By combining the signals, the mixer device 108 generates an audio mix signal.

The mixer device 108 output the audio mix signal to an audio output. In one embodiment, the audio output is connected to earphones or speakers that convert the audio mix signal into sound. By combining a noise canceling signal with a media item noise signal a user is able to enjoy the audio of a media item without ambient noise. For example, where the entertainment system 100 is on a commercial airplane, a passenger can enjoy ambient noise free audio without having to bring on the plane specialized equipment (e.g., earphones with resident active noise cancellation circuitry) since the on-board entertainment system 100 is generating the noise cancelling signal.

Figure 8:
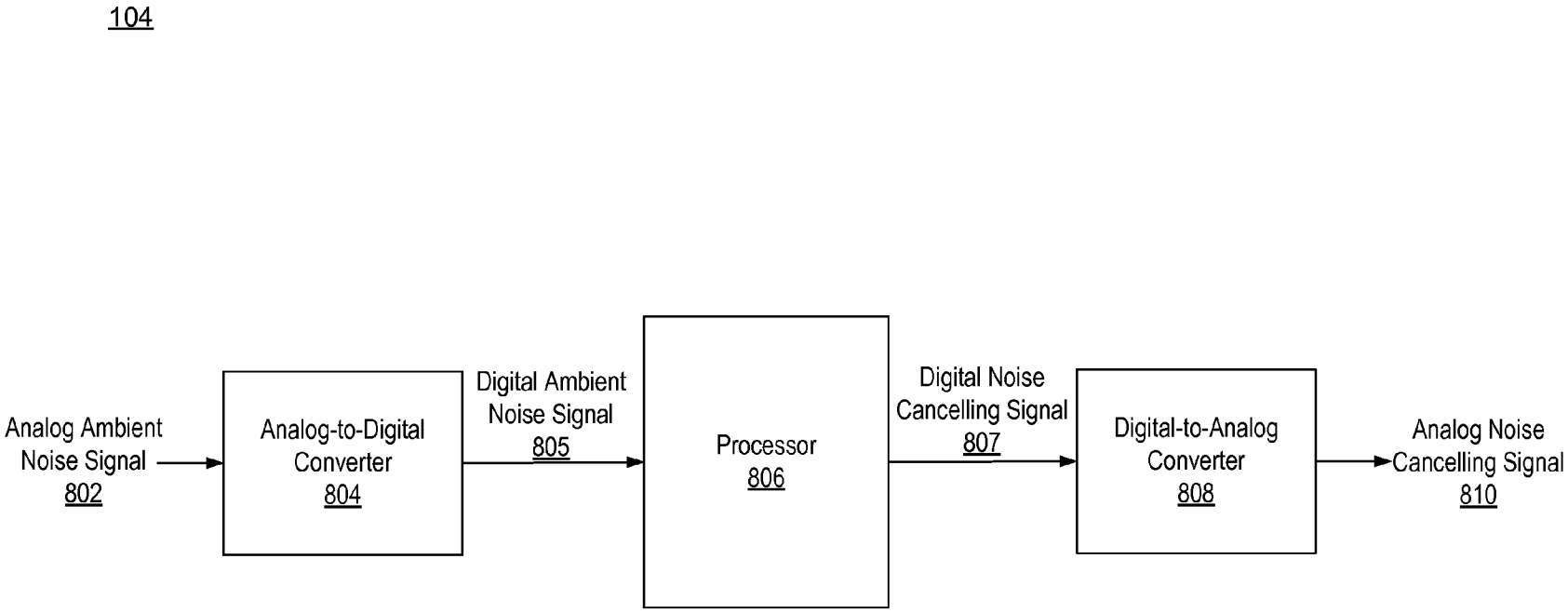
FIG. 8 illustrates a circuit diagram of a noise cancellation device according to one embodiment.

FIG. 8 illustrates a circuit diagram of the noise cancellation device 104 according to one embodiment. The noise cancellation device 104 includes an analog-to-digital converter (A/D converter) 804, a processor 806, and a digital-to-analog converter (D/A converter) 808. The A/D converter 804 receives an analog ambient noise signal 802 generated by the microphone 206. The A/D converter 804 samples the analog ambient noise signal 802 to generate a digital ambient noise signal 805 that is output to the processor 806. The processor 806 receives the digital ambient noise signal 805 and uses digital signal processing to generate a digital noise cancelling signal 807 as described above with respect to FIG. 1. The processor 806 outputs the digital noise cancelling signal 807 to the D/A converter 808. The D/A converter 808 converts the digital noise canceling signal 807 to an analog noise cancelling signal 810 and outputs the signal 812 to the mixer device 108.

Figure 9:
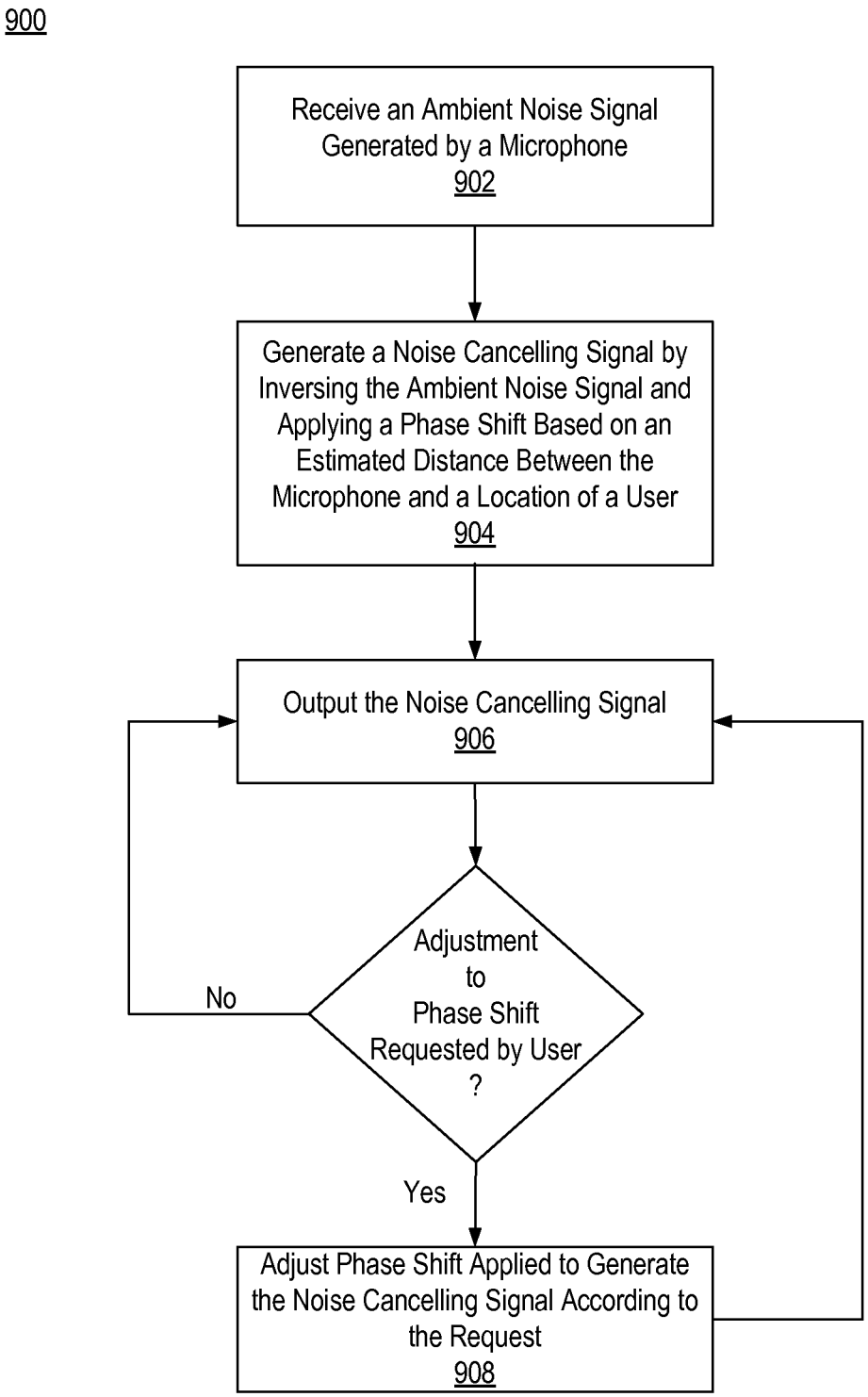
FIG. 9 is a flow chart illustrating operations of a noise cancellation device according to one embodiment The figures depict, and the detail description describes, various non-limiting embodiments for purposes of illustration only. One skilled in the art will readily recognize from the following discussion that alternative embodiments of the structures and methods illustrated herein may be employed without departing from the principles described herein.

FIG. 9 is a flow chart 900 illustrating operations of the noise cancellation device 104 according to one embodiment. Those of skill in the art will recognize that other embodiments can perform the steps of FIG. 9 in different orders. Moreover, other embodiments can include different and/or additional steps than the ones described here.

Assume for purposes of this example that a user on an airplane requests access to a media item from the entertainment device 102 which is mounted on the back of an airplane seat in front of the user. Further, assume that the active noise cancellation feature is automatically enabled and the microphone 206 of the entertainment device 102 captures ambient noise. The microphone 206 generates an ambient noise signal based on the captured ambient noise.

The noise cancellation device 104 receives 902 the ambient noise signal generated by the microphone 206. The noise cancellation device 104 generates 904 a noise cancelling signal by inverting the ambient noise signal and applying a phase shift to the ambient noise signal. The phase shift applied is based on an estimated distance between the microphone 206 and a location of the user (e.g., location of the user's head/ears). The phase shift is a time required for the ambient noise to travel the estimated distance. The noise cancellation device 104 outputs 906 the noise cancelling signal. The noise cancelling signal is mixed with the audio of the media item.

If the user requests an adjustment to the phase shift being applied to generate noise cancelling signal, the noise cancellation device 104 adjusts 908 the phase shift being applied according to the request. The noise cancellation device 104 outputs 906 the adjusted noise cancelling signal.

The disclosure herein has been described in particular detail with respect to one possible embodiment. Those of skill in the art will appreciate that other embodiments may be practiced. First, the particular naming of the components and variables, capitalization of terms, the attributes, data structures, or any other programming or structural aspect is not mandatory or significant, and the mechanisms that implement the invention or its features may have different names, formats, or protocols. Also, the particular division of functionality between the various system components described herein is merely exemplary, and not mandatory; functions performed by a single system component may instead be performed by multiple components, and functions performed by multiple components may instead performed by a single component.

Some portions of above description present features in terms of algorithms and symbolic representations of operations on information. These algorithmic descriptions and representations are the means used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the embodiments disclosed herein include process steps and instructions described herein in the form of an algorithm. It should be noted that the process steps and instructions could be embodied in software, firmware or hardware, and when embodied in software, could be downloaded to reside on and be operated from different platforms used by real time network operating systems.

The algorithms and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, the present invention is not described with reference to any particular programming language. It is appreciated that a variety of programming languages may be used to implement the teachings of the present invention as described herein, and any references to specific languages are provided for invention of enablement and best mode of the present invention.

The embodiments disclosed herein are well suited to a wide variety of computer network systems over numerous topologies. Within this field, the configuration and management of large networks comprise storage devices and computers that are communicatively coupled to dissimilar computers and storage devices over a network, such as the Internet.

Finally, it should be noted that the language used in the specification has been principally selected for readability and instructional purposes, and may not have been selected to delineate or circumscribe the inventive subject matter. Accordingly, the disclosure herein is intended to be illustrative, but not limiting, of the scope of the invention, which is set forth in the following claims.

What is claimed is:

1. A computer-implemented method for limiting ambient noise, the method comprising:

receiving an ambient noise signal generated by a microphone, the ambient noise signal representative of ambient noise in an airplane and generated based on a passenger of the airplane requesting access to a media item via an entertainment device that includes the microphone;

identifying height information of the passenger from a loyalty program profile created based on the passenger registering with a loyalty program;

estimating a distance between the microphone and a location of the user based on the height information;

determining a phase shift based on the estimated distance;

generating a noise cancelling signal by inverting the ambient noise signal and applying the determined phase shift to the ambient noise signal; and outputting the noise cancelling signal by a transducer for limiting ambient noise.

2. The method of claim 1, further comprising:

responsive to the passenger requesting a phase shift adjustment to the noise cancelling signal, adjusting, according to the request, the phase shift applied to generate the noise cancelling signal; and outputting the adjusted nose cancelling signal.

3. The method of claim 1, wherein the noise cancelling signal is mixed with audio of the media item.

4. The method of claim 1, wherein the loyalty program is associated with an airline operating the airplane.

5. A computer-implemented method for limiting ambient noise, the method comprising:

receiving an ambient noise signal generated by a microphone based on captured ambient noise, an entertainment device operated by a user including the microphone;

identifying height information of the user from a loyalty program profile created based on the user registering with a loyalty program;

estimating a distance between the microphone and a location of the user based on the height information;

determining a phase shift, based on the estimated distance;

generating a noise cancelling signal based on the ambient noise signal and the phase shift; and outputting the noise cancelling signal by a transducer for limiting ambient noise.

6. The method of claim 5, wherein generating the noise cancelling signal comprises:

inverting the ambient noise signal; and applying the phase shift to the inverted ambient noise signal.

7. The method of claim 5, wherein generating the noise cancelling signal comprises:

applying the phase shift to the ambient noise signal; and inverting the shifted ambient noise signal.

8. The method of claim 5, further comprising:

responsive to the user requesting a phase shift adjustment to the noise cancelling signal, adjusting, according to the request, the phase shift applied to generate the noise cancelling signal; and outputting the adjusted nose cancelling signal.

9. The method of claim 5, wherein the noise cancelling signal is mixed with audio of the media item.

10. A system for limiting ambient noise, the system comprising:

an entertainment device configured to receive a request from a user to access a media item;

a microphone included with the entertainment device configured to generate an ambient noise signal representative of captured ambient noise;

a noise cancellation device configured to:

identify height information of the user from a loyalty program profile created based on the user registering with a loyalty program;

estimate a distance between the microphone and a location of the user based on the height information;

determine a phase shift on the estimated distance;

generate a noise cancelling signal based on the ambient noise signal and the phase shift; and a mixer device configured to mix the noise cancelling signal with audio of the media item.

11. The system of claim 10, wherein the noise cancellation device is further configured to:

invert the ambient noise signal; and apply the phase shift to the ambient noise signal.

* * * * *